US005704802A

United States Patent [19]

Loudermilk

[11] Patent Number: 5,704,802

[45] Date of Patent: Jan. 6, 1998

[54] MODULAR JACK ASSEMBLY

[75] Inventor: Gregory Loudermilk, Sacramento, Calif.

[73] Assignee: Maxconn Incorporated, San Jose, Calif.

[21] Appl. No.: 664,144

[22] Filed: Jun. 14, 1996

[51] Int. Cl.[6] ..... H01R 3/00

[52] U.S. Cl. ..... 439/490; 439/676

[58] Field of Search ..... 439/488, 489, 439/490, 676, 717, 344

[56] References Cited

U.S. PATENT DOCUMENTS

| | | | |
|---|---|---|---|
| 4,425,018 | 1/1984 | Stenz | 439/717 |
| 4,978,317 | 12/1990 | Pocrass | 439/490 |
| 5,419,720 | 5/1995 | Chen | 439/676 |
| 5,478,261 | 12/1995 | Bogese, II | 439/676 |
| 5,613,876 | 3/1997 | Bell, Jr. | 439/490 |

*Primary Examiner*—Khiem Nguyen

*Assistant Examiner*—Yong Ki Kim

*Attorney, Agent, or Firm*—Terry McHugh

[57] ABSTRACT

A modular jack assembly includes a housing having a plug-receiving cavity and an LED assembly attached atop the plug receiving cavity. In a preferred embodiment, the LED assembly is integrally formed with the housing. The LEDs are encased within the LED assembly, being separated from the plug-receiving cavity by a partition. This isolation of the LED helps to minimize the coupling of EMF interference radiated by the leads of the LED while they are operating to the underlying contact pins. Contact pins disposed within the plug-receiving cavity each have a contacting portion which extends along the roof of the cavity. The contacting portions have a varying measure of separation from the roof along their extent. This provides further separation from the LED leads which are disposed above the contact pins in the LED assembly, further lessening the EMF coupling with the LED leads. In an alternate embodiment, the modular jack has a stacked form factor and can be ganged to form a bank of modular jacks.

21 Claims, 8 Drawing Sheets

MODULAR JACK ASSEMBLY

TECHNICAL FIELD

The present invention generally relates to modular jacks and more specifically to modular jacks which can incorporate a light emitting diode assembly.

BACKGROUND ART

Modular connectors are frequently used in communication and computer peripheral equipment system in large numbers for the transmission of voice and data. The modular connectors known as RJ7 (4 position), RJ11 or RJ12 (6 position), RJ45 or RJ48 (8 position) and many others in their standard sizes are commonly used to connect communication and computer peripheral equipment for transmitting voice and data. Typically, the modular jack connectors are used both in singular format and in multiple port configurations. Data and voice communications lines are linked by using industry standard plug connectors terminated to cable, which then plug into the modular jacks.

A typical installation employs a large number of data and voice communication lines. When a line becomes faulty, it is important that the line be quickly identified and the problem corrected so that down-time is kept to a minimum. Troubleshooting a communication fault typically begins by determining whether data is being transmitted, or a disconnected or otherwise faulty cable is the problem. In a site which uses a large number of lines, this first step of identifying the faulty line can be time consuming.

The typical application will have indicator lights known as light emitting diodes (LEDs) on the printed circuit board. The LEDs indicate whether the circuit is on or off cable and whether data is being transmitted in addition to indicating other types of activity through the line. Two approaches currently in practice for attaching LEDs to a printed circuit board are shown in FIGS. 14A and 14B. In FIG. 14A a bank of LEDs 12 is positioned separately from their corresponding ports 10. Troubleshooting such boards is difficult because the LEDs are not close to the ports, requiring the technician to identify each LED with each port. FIG. 14B shows the use of a light bar 24 which is mounted to the port 20 of each line. An LED 22 is mounted behind the port 20, its light being directed to the front of the port by the light bar 24. This approach consumes valuable real estate on the printed circuit board. In addition, light bars incur extra costs in terms of material and manufacture. Light bars also are less reliable and tend to fall off.

A newer approach incorporates the LED directly into the modular jack housing. With this approach, activity on the line can be immediately identified, thus enabling a technician to quickly ascertain which line has failed. The technology continues to demand more space for sophisticated communications equipment such as ATM (asynchronous transfer mode) transceivers, high speed modems, LAN/WAN NIC (network interface cards) and ISDN products for use in the home and small office environment. At the same time, the user must be able to easily troubleshoot or identify faults. Modular jacks having built-in LEDs therefore becomes a valuable feature for OEM manufacturers of this type of equipment as they conserve space and facilitate troubleshooting.

Typically, a pair of LEDs is provided within the housing of each modular jack. The LEDs are connected to operate synchronously with their corresponding transmit and receive lines to turn on whenever data is being transmitted over the lines. However, the high data rates of the communication lines result in correspondingly high LED flash rates. The LED leads, therefore, tend to act as antennae, radiating EMF energy as LEDs are being flashed. Since the LEDs are in close proximity to the signal pins, which are also located within the housing, there tends to be cross-coupling of the radiated EMF to the signal pins, thus adversely affecting the data being transmitted. For example, spurious signals may be generated and signal dropouts may occur, both resulting in the erroneous transmission or reception of data.

As a practical matter, there is another shortcoming with the prior art approach when modular jacks are used in a patch panel arranged along two rows. The cables are plugged into the patch panel and drape in front of the panel. Thus, the cables which plug into the upper row of jacks hang down in front of the jacks in the lower row. In most applications, the multitude of cables plugged into a patch panel will very likely block the view to the jacks in the lower row of the patch panel. Consequently, the view of the LEDs formed in the jack assemblies are obstructed by the cables and one cannot readily ascertain the status of the jack simply by glancing at the panel.

In addition to the foregoing, manufacturers are concerned about the cost of replacing such products as a modular jack with built-in LEDs, if an LED fails when the modular jack is installed in the manufacturer's equipment. Typically, if an LED fails in a single or multiple gang modular jack, the jack cannot be used and must be removed from the populated printed circuit board. This becomes very costly to the manufacturers of such components because the repair cannot be easily performed in the field. A user of such equipment must remove the board from the system and send it to the manufacturer for repair; meanwhile the user's system is down for the duration.

What is considered to be the optimum application by a majority of the network and computer peripheral equipment manufacturers in today's market is an arrangement of a modular jack connector or connectors having several modular jack ports with built-in LED circuitry which allows clear line-of-site monitoring of the activity of the individual ports. Activity is defined, for each port, as send data and receive data transmission. Another desirable feature is the flexibility in determining which ports will be equipped with LED-provided modular jacks, and what type of connector (RJ-11, RJ-45, etc.) to use. It is also desirable to have a modular jack with a built-in LED circuit which can avoid the cross-coupling effect of the noise generated by high LED flash rates.

SUMMARY OF THE INVENTION

The modular jack of the present invention includes a housing having a plug-receiving cavity. A forward aperture opens into the cavity. Contact pins are disposed within the cavity and have downwardly bent portions which protrude through the bottom of the housing. An LED assembly disposed atop the housing has a chamber which includes at least one LED (and preferably three LEDs), the leads of which are entirely enclosed within the chamber.

In a preferred embodiment, the LED assembly and the housing are a unitary member of insulative material. The chamber of the LED assembly is separated from the plug-receiving cavity by a partition. The unitary arrangement has the advantage of providing an LED-containing modular jack having a low profile. In addition, it has been found that the presence of the partition serves to attenuate the EMF radiation generated by the operation of the LEDs. Thus, by fully encasing the LED leads within the chamber of the LED assembly, adequate EMF shielding is provided.

In accordance with the present invention, the LEDs are removably installed within the LED assembly. Thus, faulty LEDs can be easily replaced in the field without interrupting the use of the rest of the modular jack connectors or their corresponding ports, thus minimizing system downtime. In addition, the user may select among the different colored LEDs to suit the needs of the particular application. Preferably, the LED assembly of each modular jack can accommodate three LEDs.

In an alternate embodiment, both the housing and the LED assembly have complementary coupling members which allow the two to be connected. An advantage of this embodiment is the easy replacement of the LED assembly. EMF shielding is still provided in the alternate embodiment, since the housing and the LED assembly are separate and self-contained units.

The housing of the modular jack additionally includes a coupling member formed on its exterior surface. The coupling member is either a raised notch member or a notched recess formed on the exterior of the housing. A left-side modular jack has a coupling member formed on the exterior right side of the housing. Similarly, a right-side modular jack has a coupling member formed on the exterior left side of the housing. Finally, a middle member has a coupling member formed on both the left side and the right side of its housing. Thus, a gang of modular jacks can be assembled simply by connecting together a number of middle members with a left and a right member connected at the ends. In fact, a gang consisting of an assortment of types of modular jacks (RJ-11, RJ-45, etc.) can be constructed.

In yet another embodiment, the modular jack has a stacked arrangement. The housing includes two vertically-aligned plug-receiving cavities, each having contact pins formed therein. An LED assembly having two vertically-aligned chambers is disposed atop the plug cavities. In one variation of the embodiment, the LED assembly is integrally formed with the housing. In another variation, the housing and the LED assembly are separate units and are connected together by coupling members formed on each unit. By positioning the LEDs atop the stack, visual acquisition of the LEDs is possible despite the multitude of cables plugged into the stack.

The stacked modular jacks can be assembled in a ganged manner. Coupling members formed on the sides of the housing allow individual modular jacks to be connected together in a manner similar to the ganged modular jacks described above.

The LED assembly of a stacked modular jack further includes a printed circuit board to which the LED leads are attached. Traces formed on the printed circuit board provide a conductive path to contact pads formed near the edge of the printed circuit board. Lead wires attached to the contact pads extend in a downward direction, and together with the protruding portions of the contact pins assist in mounting the modular jack assembly to a motherboard. Circuitry can then be formed on the motherboard to turn the LEDs on whenever signals are being carried on the contact pins.

In each of the above-described embodiments, the contact pins disposed within the plug-receiving cavity are uniquely shaped to keep the EMF coupling between the LED leads and the contact pins to a minimum. The portions of the contact pins which extend along the ceiling of the plug cavity vary in their distance from the ceiling along their extent. Thus, the LED leads which lie directly above the contact pins are kept as far away from the contact pins as possible, while at the same time allowing the contact pins to come into contact with the pins of a modular plug that is received within the cavity. Thus, the unique shape of the contact pins of the present invention, in conjunction with the partition provided between the LED chamber and the plug cavity, provides improved EMF shielding over the prior art approaches.

The design of the modular jack of the present invention lends itself to the manufacture of a cost competitive product. The ability to easily customize a circuit board with an assortment of modular jacks (RJ-11, RJ-45, etc.) allows customization of the ports for a particular circuit board to be a standard operation during the manufacturing process. The flexibility of the removable LEDs allows easy and cost-effective maintenance of the jack. Overall, the modular jack systems of the present invention will tend to be less intricate than prior art jacks, whether in single or ganged form and with or without LEDs.

BEST MODE FOR CARRYING OUT THE INVENTION

Figure 1:
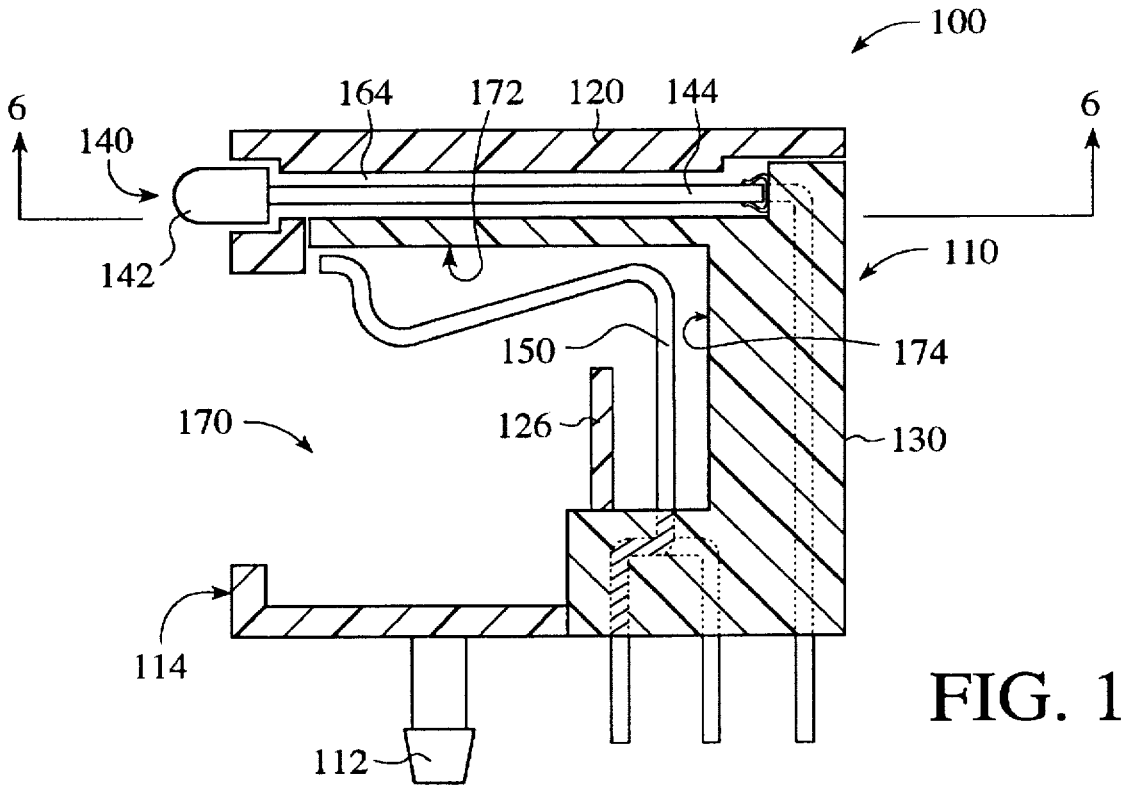
FIGS. 1 and 2 are side and front views, respectively, of a modular jack assembly of the present invention.
Figure 2:
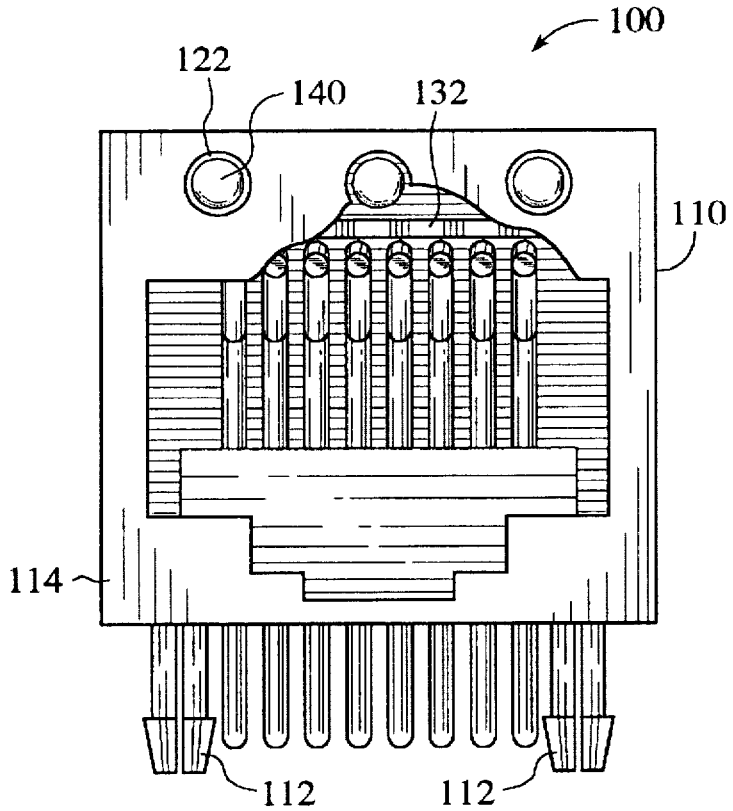

FIGS. 1 and 2 show a modular jack assembly 100 in accordance with the present invention. The side view of FIG. 1 shows a housing 110 for receiving a modular plug (not shown) and an LED 140 received in an aperture 122 (FIG. 2) formed in the housing. The housing is formed of insulative material. Contact pins 150 are disposed within a cavity 170 of the housing 110. An aperture 124 formed in the front 114 of the housing serves to receive the modular plug (not shown). The contact pins 150 extend downwardly through the bottom of the housing 110, protruding externally with respect to the housing. Mounting pegs 112 are formed at the bottom of the housing and extend in a downward direction. Together with the contact pins 150, the mounting pegs 112 provide a means for mounting the modular jack 100 to a motherboard (not shown).

Figure 3A:
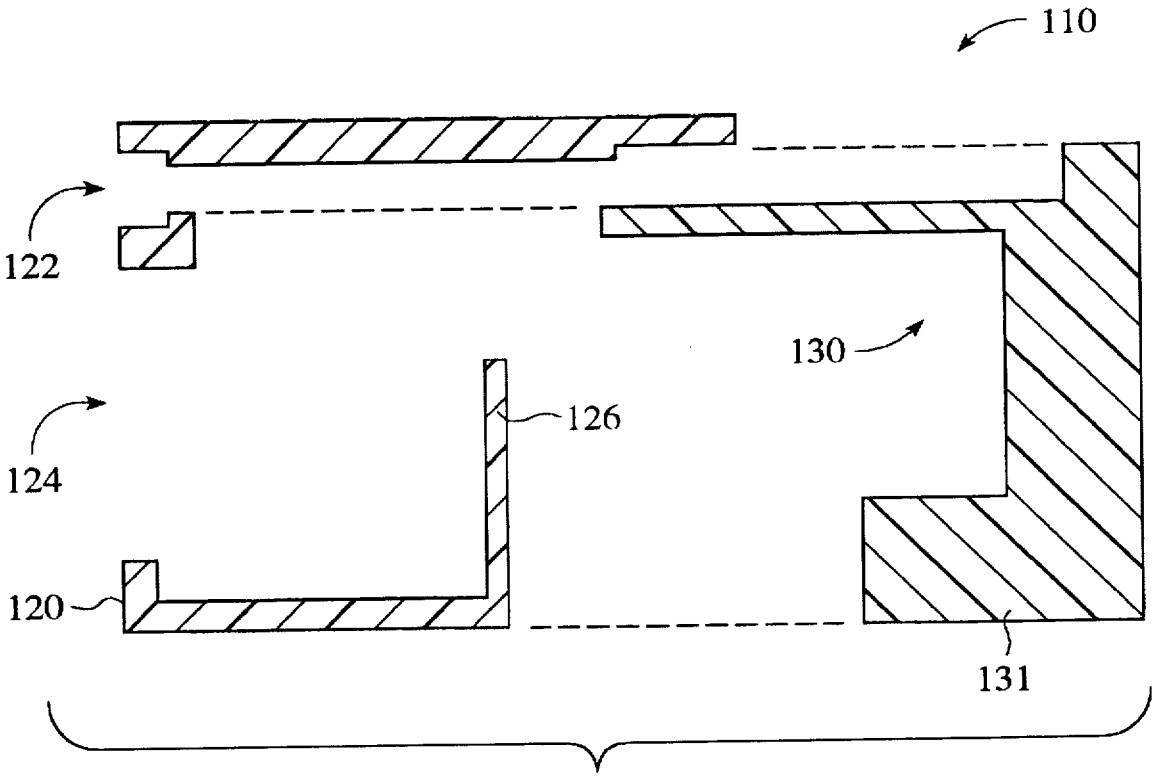
FIGS. 3A and 3B show an exploded view and an assembled view of the housing of the modular jack of FIG. 1.
Figure 3B:
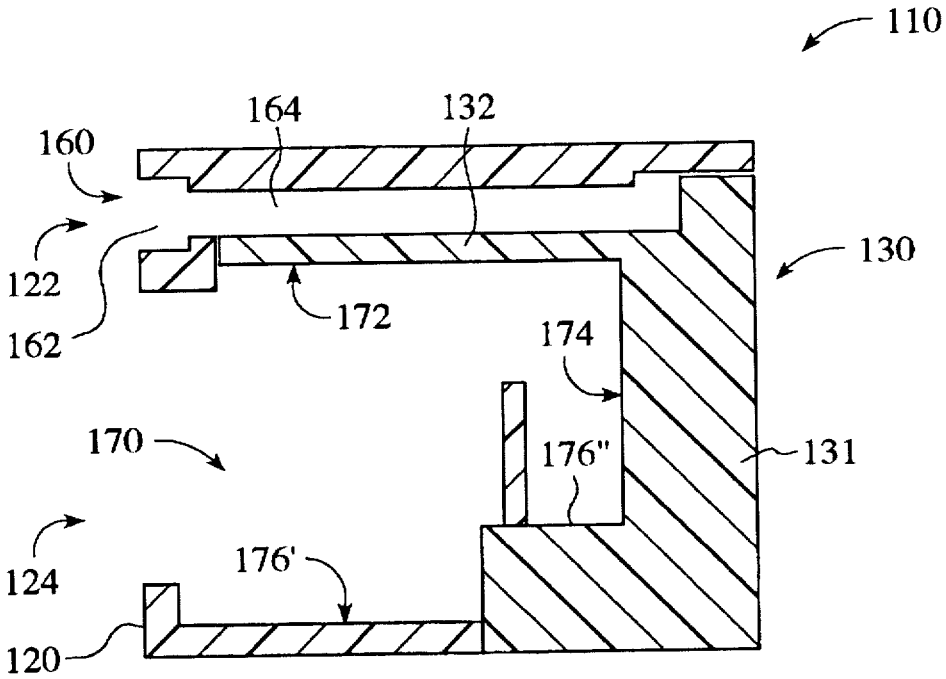

Additional detail of the housing 110 is provided with reference to the exploded and assembled views illustrated in FIGS. 3A and 3B. As can be seen, the housing is composed of a shell 120 and a rear insert 130. Elements of the rear insert have been omitted to simplify the drawings in FIGS. 3A and 3B, but will be explained below. The shell 120 provides the top aperture 122 and bottom aperture 124 for respectively receiving the LED 140 and a modular plug (not shown), as described above with respect to FIGS. 1 and 2. The shell also includes an upright member 126 formed toward the rear of the shell.

Figure 4:
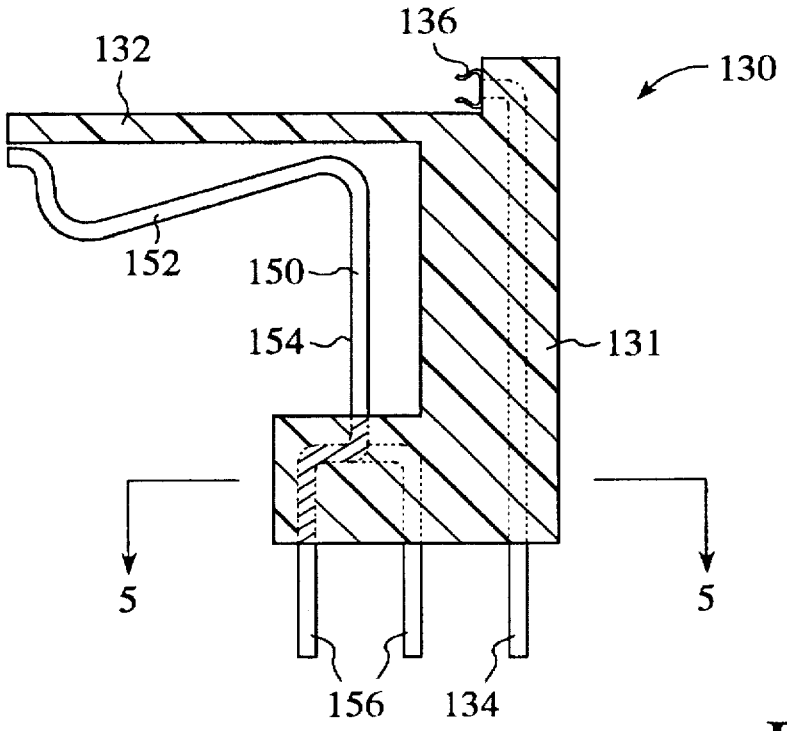
FIGS. 4 and 5 illustrate the side and bottom views of the rear insert.
Figure 5:
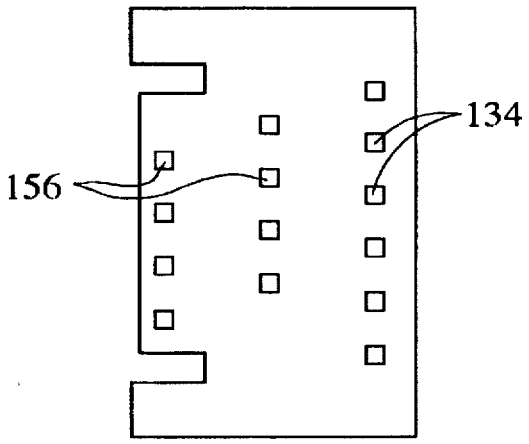

Turning to FIGS. 4 and 5 for the moment, additional detail of the rear insert 130 will now be described. The rear insert 130 is an insulative member having a cantilevered member 132 extending from a main body 131 of the rear insert. Contact pins 150 and the connector leads of a lead frame 134 are formed in the body 131 of the rear insert 130. The contact pins 150 have a portion 156 which protrudes from the bottom of the rear insert 130. Similarly, the connector leads of the lead frame 134 are formed within the main body 131 and extend from the cantilevered portion 132 through the bottom of the rear insert 130. An internal socket 136 is disposed upon the cantilevered member 132 and is connected to the connector leads of the lead frame 134.

FIG. 5 shows the pattern of the pins 156, 134 as they appear from the bottom of the rear insert 130, looking up. As shown in FIG. 5, there are eight contact pins 150 disposed in the rear insert 130, and the lead frame 134 is composed of six connector leads.

Returning to FIGS. 3A and 3B, the housing 110 is assembled by inserting the rear insert 130 into the rear opening of the shell 120. Upon doing so, an LED assembly 160 and a plug receiving cavity 170 are formed, the former being disposed above the latter. The LED assembly 160 includes a chamber for receiving an LED (140, FIG. 1), the chamber being divided into a bulb chamber 162 and an LED lead chamber 164. The cantilevered member 132 of the rear insert 130 serves as a partition between the LED assembly 160 and the plug cavity 170. The plug cavity 170 is composed of a floor and a rear wall 174. The floor is composed of two portions 176', 176", the first portion 176' of which is defined by the shell 120 and the second portion 176" of which is defined by the rear insert 130. The cantilevered member 132 defines a ceiling 172 within the plug cavity 170.

Completion of the assembly of the modular jack is explained with reference to FIGS. 1, 3A, 3B, 4 and 6. An LED 140 is received in the LED assembly, the bulb 142 being positioned in the bulb chamber 162 and the LED leads 144 being disposed in the lead chamber 164. The leads 144 engage corresponding internal sockets 136 and are held in place by a spot welding technique or by similar otherwise known techniques. In a preferred embodiment, the LED 140 simply engages the internal sockets 136 by a friction fit. Thus, it is easy to remove and replace LEDs without adversely impacting the operation of an installed board, a very desirable maintenance feature. In addition, the ability to plug in new LEDs allows a system operator to easily customize the board with differently colored LEDs.

Figure 6:
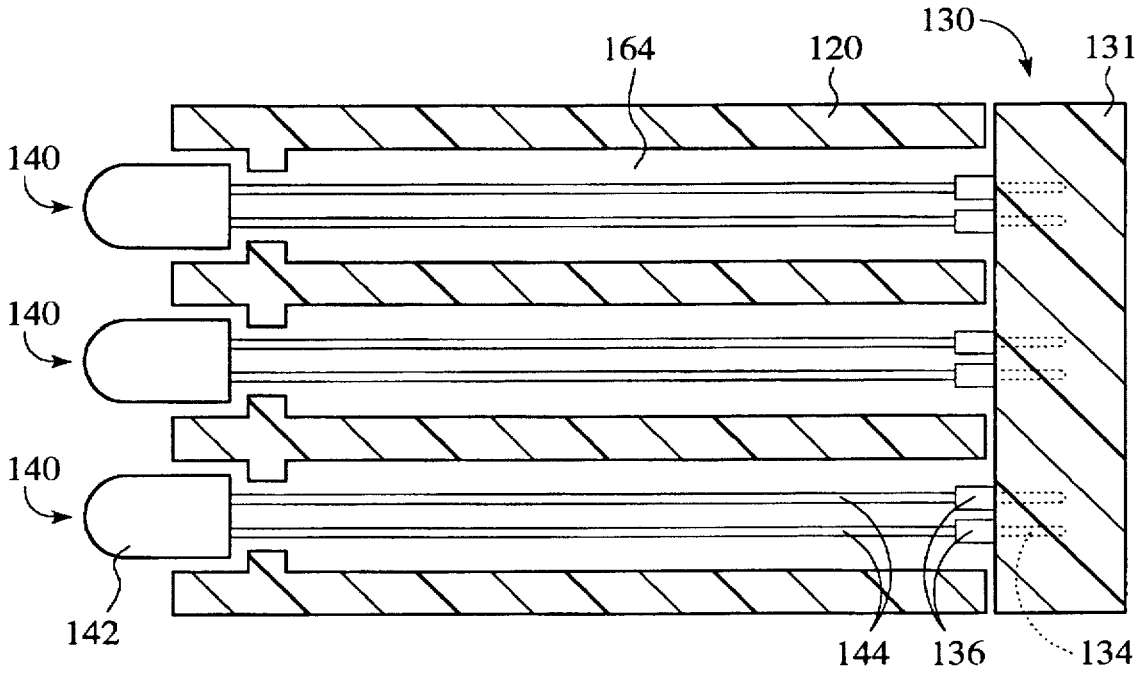
FIG. 6 shows a cutaway view of the top of the assembly in FIG. 1.

Also in the preferred embodiment of the invention, the modular jack assembly 100 is equipped with three LEDs 140. FIG. 6 is a cross-sectional view of the jack assembly as shown by the view line 6—6 in FIG. 1. The figure shows three LEDs 140 received within the chambers of the LED assembly. The leads 144 are coupled to corresponding internal sockets 136 formed in the rear insert 130. A top view of the lead frame 134 shows the individual connector leads (in phantom) of the lead frame, formed in the main body 131 of the rear insert 130. In order to maintain a low profile, the LED 140 is positioned so that the leads 144 lie flat along a horizontal plane, as indicated in FIG. 6. It should be noted, however, that the leads may be oriented vertically, or at any angle relative to the horizontal, without affecting the operation of the modular jack.

As shown in FIG. 1, insertion of the rear insert 130 into the shell 120 positions the contact pins 150 within the resulting plug cavity 170. The upright member 126 of the shell 120 is situated near to the upright portions of the contact pins 150, thus providing some degree of vertical support for the pins. The pins 150 are placed so that one end of the pins is near to the aperture 124 of the housing 110 and proximate the ceiling 172 of the plug cavity, as shown by the cutaway portion seen in FIG. 2. A contacting portion of the pins extends rearwardly along the ceiling 172, as shown in FIG. 1.

The modular jack of the present invention has advantages over prior art modular jack/LED combinations. In the prior art, the LEDs are located within the housing which contains the contact pins. The leads of the LEDs, therefore, are in very close proximity to the contact pins. The EMF generated as a result of the high flash rate of the LEDs induces unwanted noise in the contact pins, having adverse effects on the data carried by the pins, such as drop-outs and garbling of the data. The advantage of the present invention lies in the containment of the LED leads 144 within the lead chamber 164. It has been found that the cantilevered member 132, which is disposed between the leads 144 from the contact pins 150, attenuates EMF radiation emitted by the leads 144 when the LED 140 is operated at high frequencies. Since the dielectric constant of the insulative partition is higher than that of air, it is believed that the presence of the partition results in a decrease in capacitive coupling between the LED leads 144 and the signal pins 150, thus attenuating the high frequency components of the EMF radiation. This provides a degree of EMF shielding that is not found in prior art approaches.

Figure 7:
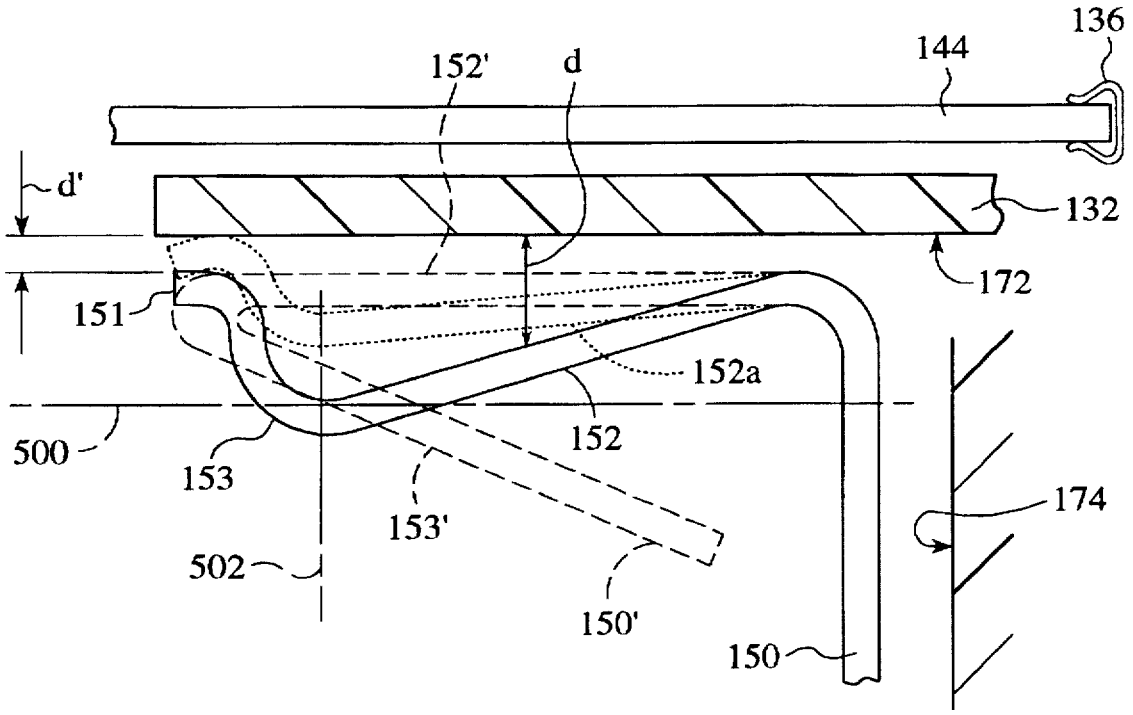
FIG. 7 compares the contact pin of the present invention with the prior art contact pin.

Additional protection against EMF radiation is achieved by the unique shape of the contact pins 150 of the present invention, which is more clearly illustrated in FIG. 7. The relative dimensions of the elements shown in FIG. 7 have been exaggerated for illustrative purposes. The figure is an enlarged view of the plug-receiving cavity 170 of FIG. 1, showing the ceiling 172 and the rear wall 174 of the cavity, a segment of the LED leads 144, and the partition 132 which separates the lead chamber 164 (FIG. 1) from the cavity. FIG. 7 also shows a line of contact 500, indicating where the contact pins will make electrical contact with a modular plug when the plug is inserted into the cavity. The location of the line of contact 500 is set in accordance with the standards set by the industry, which define standard sizes for modular jacks and modular plugs.

FIG. 7 depicts, in phantom, a contact pin 150' that is typically used in prior art modular jacks. A transverse segment 152' of the prior art contact pin 150' extends from the rear wall 174, along the ceiling 172 and toward the front of the plug cavity. Near the front, the contact pin 150' bends backward and continues toward the rear of the plug cavity. The bent portion 153' projects below the line of contact 500, so as to ensure reliable electrical contact with a modular plug when the plug is received in the cavity.

Turn now to the contact pin 150 of the present invention, also shown in FIG. 7. A tip 151 of the contact pin 150 is located near the front of the plug-receiving cavity proximate to the ceiling 172. A transverse segment 152 of the contact pin 150 extends rearwardly along the ceiling, wherein the separation d between the transverse segment and the ceiling varies along the length of the transverse segment. In a preferred embodiment, the transverse segment 152 extends downwardly away from the ceiling 172 of the cavity to a point of maximum separation 502. From there, a bend 153 in the segment 152 causes the segment to approach the ceiling as the segment continues to extend toward the rear of the cavity. The amount of separation at the maximum separation point 502 is sufficient to position the bend 153 in the segment 152 below the line of contact 500. When a modular plug is inserted, the segment 152 will be displaced in an upward direction by virtue of conductive contacts formed in the plug pushing against the bend 153, the displaced segment 152*a* being shown in phantom. However, due to the resiliency of the metal of the contact pin 150, the bent transverse segment 152 is biased in a downward direction. This downward bias provides a reliable electrical contact with the contacts of the modular plug and ensures that the transverse segment will return to its original shape when the plug is removed.

The advantage of the contact pin 150 over the prior art contact pin 150' is that the EMF interference from the LED leads 144 is minimized by the structure of the present invention contact pin 150. The transverse segment 152' of the prior art contact pin 150' is positioned close to the ceiling 172 in order that the bent portion 153' may be formed. EMF coupling with the LED leads 144 is therefore strong. In addition, the prior art segment 172' maintains a constant close spacing d' to the ceiling 172 along the entire extent of the segment, which has the undesirous result of maximizing the EMF coupling effect.

This is not the case with the transverse segment 152 of the present invention. As shown in FIG. 7, the segment 152 has only two locations that are closely spaced to the ceiling 172, one near the front of the cavity and the other toward the rear of the cavity. For the most part, the segment 172 is spaced apart from the ceiling, and therefore the LED leads 144, by a distance greater than d'. By forming all of the contact pins 150 as shown in FIG. 7, the EMF coupling from the LED leads is minimized.

The transverse segment 152 of the contact pin 150 shown in FIG. 7 has a V-shaped profile. This V-shape, however, is not critical, and alternate profiles are contemplated. For example, the transverse segment may have an arcuate profile. So long as that portion of the segment 152 which contacts the modular plug is positioned at or below the line of contact 500, alternate profiles for the transverse segment 152 may be used without affecting the operation of the present invention or sacrificing the benefits of the present invention.

The discussion will now focus on a feature of the present invention which allows the modular jack assemblies to be used as "building blocks" whereby a gang of modular jacks can be assembled. This provides maximum flexibility for a system designer who may be faced with various operating environments, requiring the ability to tailor the number of modular jacks according to constraints imposed by the particular application. The features shown in the modular jack of FIGS. 8–10 provide this flexibility.

Figures 8, 9, 10:
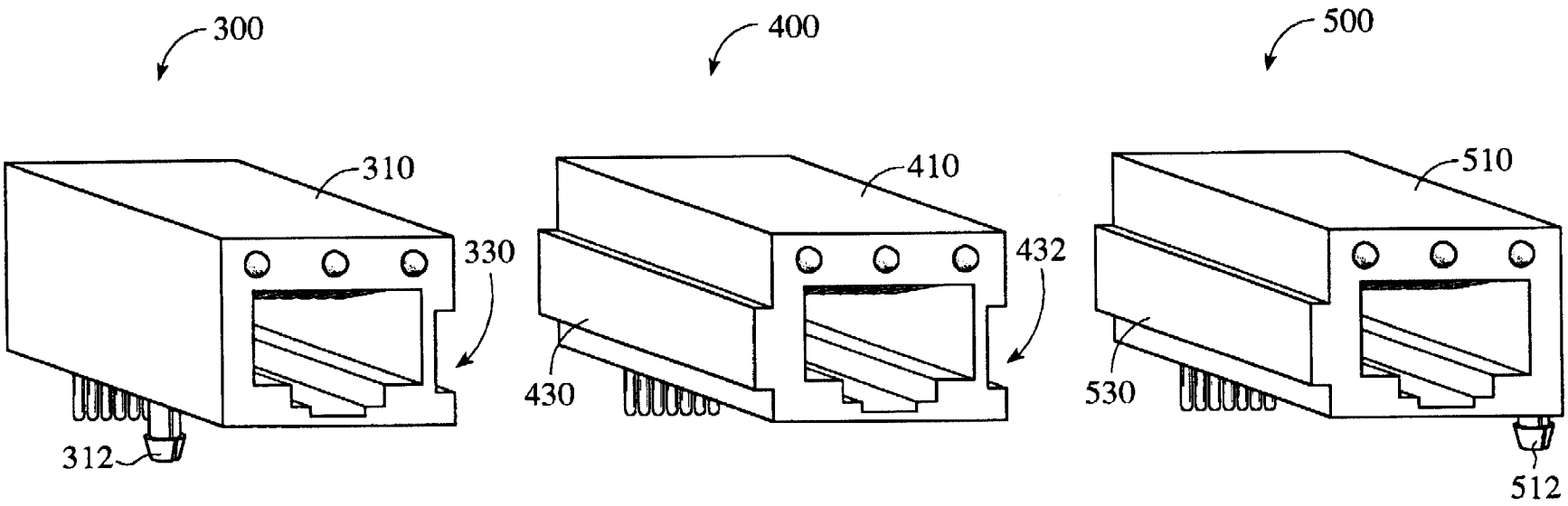
FIGS. 8–10 depict a "building block" form factor for the modular jack assembly of the present invention.

FIG. 8 shows a jack assembly 300 wherein a housing 310 includes a single mounting peg 312 formed on the bottom of the housing and a coupling member 330 formed on the right side of the housing. The coupling member 330 is composed of a recessed notch. The mounting peg 312 is formed off-center and towards the left side of the housing 310. FIG. 10 shows a jack assembly 500 wherein a housing 510 includes a mounting peg 512 formed on its bottom surface. The mounting peg 512 is formed off-center and towards the right side of the housing 510. A coupling member 530 is formed on the left side of the housing and is composed of a raised notch. The two jack assemblies 300, 500 are respectively referred to as the left-end assembly and the right-end assembly. FIG. 9 shows a jack assembly 400 wherein a housing 410 includes coupling members 430, 432 respectively formed on left and right sides of the housing 410. The left-side coupling member 430 is a raised notch and the right-side coupling member 432 is a recessed notch. The jack assembly of FIG. 9 is referred to as a middle (intermediate) assembly.

It can be seen from FIGS. 8–10 that a gang of modular jacks can be built up by piecing together any number of middle assemblies 400 with a left-end and right-end assembly 300, 500 attached at each end. The side coupling members 330, 430, 432, 530 serve to couple together the individual assemblies. A gang of two modular jacks can be formed simply by connecting together a left-end assembly 300 and a right-end assembly 500. More importantly, the present invention allows the board designer to mix and match an assortment of types of connectors, e.g. RJ-11, RJ-45, etc. Thus, the assemblies 300–500 shown in FIGS. 8–10 can be any one of a number of connector types.

In the preferred embodiment, the coupling means 330 and 432 shown in FIGS. 8 and 9 are square notches formed into the housing, while the complementary coupling means 430 and 530 shown in FIGS. 9 and 10 are square raised members. The modular jacks 300–500 are coupled together either by a friction fit or a snap-fit between the notches and raised members. This is an easy and reliable approach for quickly assembling a gang of modular jacks. The coupling members shown are not critical, however, and other shapes are contemplated. For example, the notches 330, 432 may be formed with beveled walls and the raised members 430, 530 formed with beveled sides which complement the beveled notches. The modular jacks would be coupled by slidably fitting one over the other. It can be seen that various embodiments of the coupling members are possible which allow ganging of modular jacks without adversely affecting the practice of the present invention.

Figure 11:
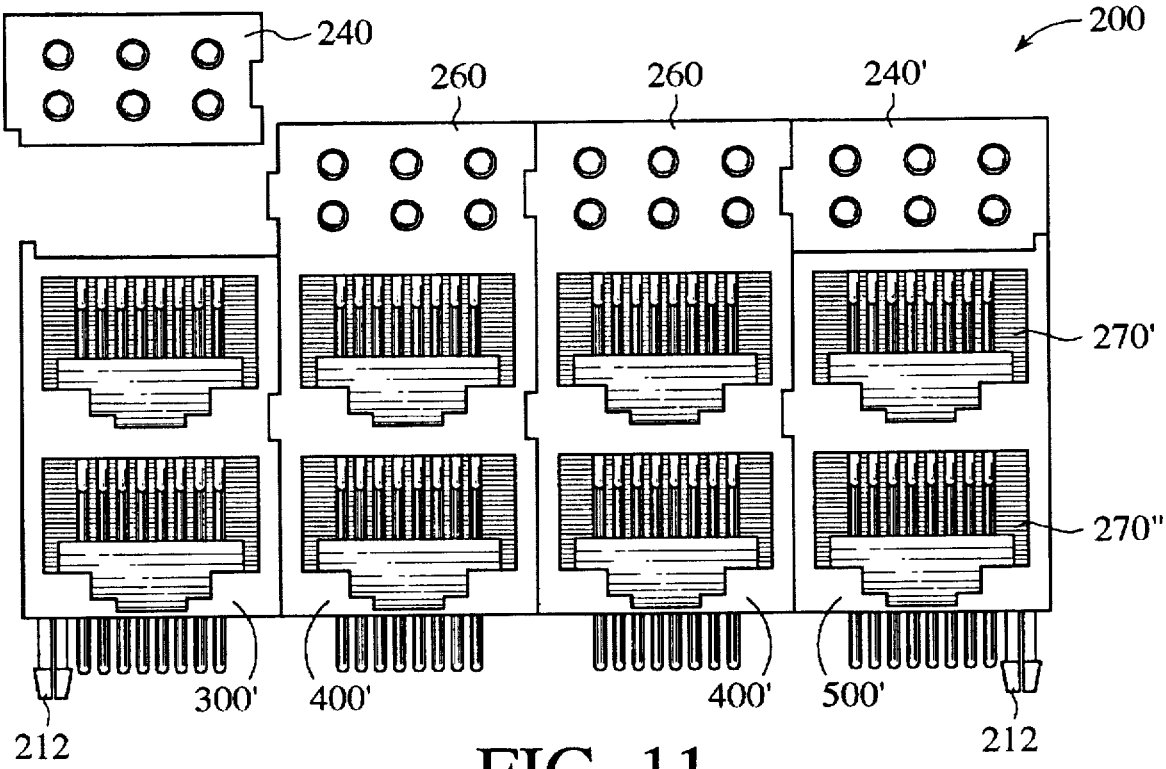
FIGS. 11 and 12 show the front and side views, respectively, of a stacked modular jack assembly in accordance with the present invention.
Figure 12:
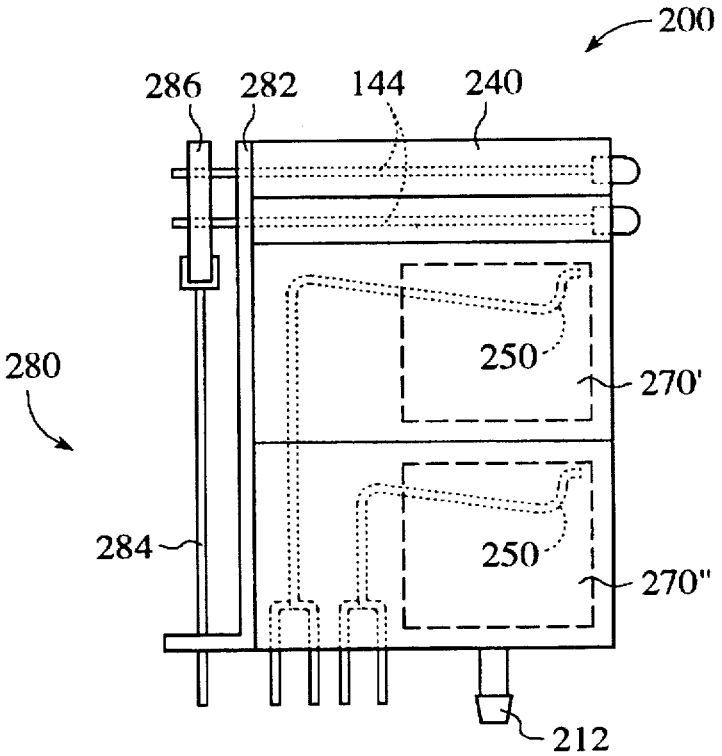

Another feature of the present invention provides for a stacked modular jack assembly that can be ganged. FIGS. 11 and 12 show a stacked modular jack arrangement. FIG. 11 shows a four-way gang of stacked modular jacks 200, employing a "building block" form factor similar to that shown in FIGS. 8–10. The building blocks include a left-end stack member 300', a middle stack member 400' and a right-end stack member 500', each having vertically-aligned upper and lower plug receiving cavities 270', 270". Each middle stack member 400' has an LED assembly 260 which, in the preferred embodiment, is integrally formed with the insulative housing of the stack member. Similar to the partition shown in FIGS. 1–3, the middle stack member includes a partition that separates the LED leads disposed within the LED assembly 260 from the signal pins of the jack. Also in the preferred embodiment of the present invention, the left-end and right-end stack members 300', 500' do not integrally incorporate an LED assembly. Rather, a separate LED assembly 240, 240' is provided. FIG. 11 shows that the separate LED assemblies 240, 240' are each composed of a rectangular member which houses LEDs. Notches formed in the housing of the left-end and right-end stack members serve to lock the LED assemblies 240, 240' into place, typically by a snap-fit or by a friction fit.

An advantage of the stacked arrangement shown in FIG. 11 is the use of and location of the stacked LED assemblies 240, 240', 260. By positioning the stacked LED assemblies at the top of the modular assembly, the LEDs cannot be blocked from view by the multitude of cables that would be plugged into the modular assembly. By comparison, prior art modular jacks which incorporate LEDs within the housing of each jack would be less functional in a stacked arrangement. The LEDs in the bottom row of jacks would be occluded because cables plugged into the upper row of jacks would drape over and in front of the lower row of jacks. This is not a problem in the present invention, since the LED assembly shown in FIG. 11 is disposed atop the jack assembly.

Turn now to FIG. 12 which shows a side view of the stacked jack assembly 200. Because the jacks are stacked, the contact pins 250 of the upper row of jacks must extend a further distance rearwardly into the housing than the contact pins of the lower row of jacks, to avoid coinciding with the lower row contact pins. This has the effect of increasing the depth of the housing member. The LED leads lack sufficient length to reach the printed circuit motherboard due to the increased length and the increased height of the LED assembly of the stacked jack assembly.

FIG. 12 shows a lead support member 280 which solves the problem by providing an electrical path between the LEDs of the LED assembly 240 and the motherboard onto which the jack assembly is to be mounted. The LED leads 144 extend the length of the LED assembly 240, emerging at the back end of the assembly. The LED leads are coupled to a printed circuit board 286 of the lead support 280. Mounting leads 284, also coupled to the printed circuit board 286, extend downwardly from the printed circuit board toward the bottom of the jack.

The lead support 280 further includes an L-shaped member 282 that is attached to the LED assembly 240. Since the mounting leads 284 are attached only to the printed circuit board 286, support must be provided to prevent the leads from being laterally displaced out of proper alignment. The L-shaped member 282 provides the needed lateral support for the mounting leads 284 at a position distal from the point of attachment of the leads to the printed circuit board 286. The leads 284 pass through the lower portion of the L-shaped member 282 and in this way remain stationary, thus ensuring proper lead spacing and alignment. Although FIG. 12 shows the lead support 280 to be a member separate from the LED assembly 240, this is not necessarily so. For example, it is possible to integrally form the lead support with the body of the assembly. Similarly constructed lead supports are provided for the LED assemblies 260 of middle stack members 400'.

Figure 13:
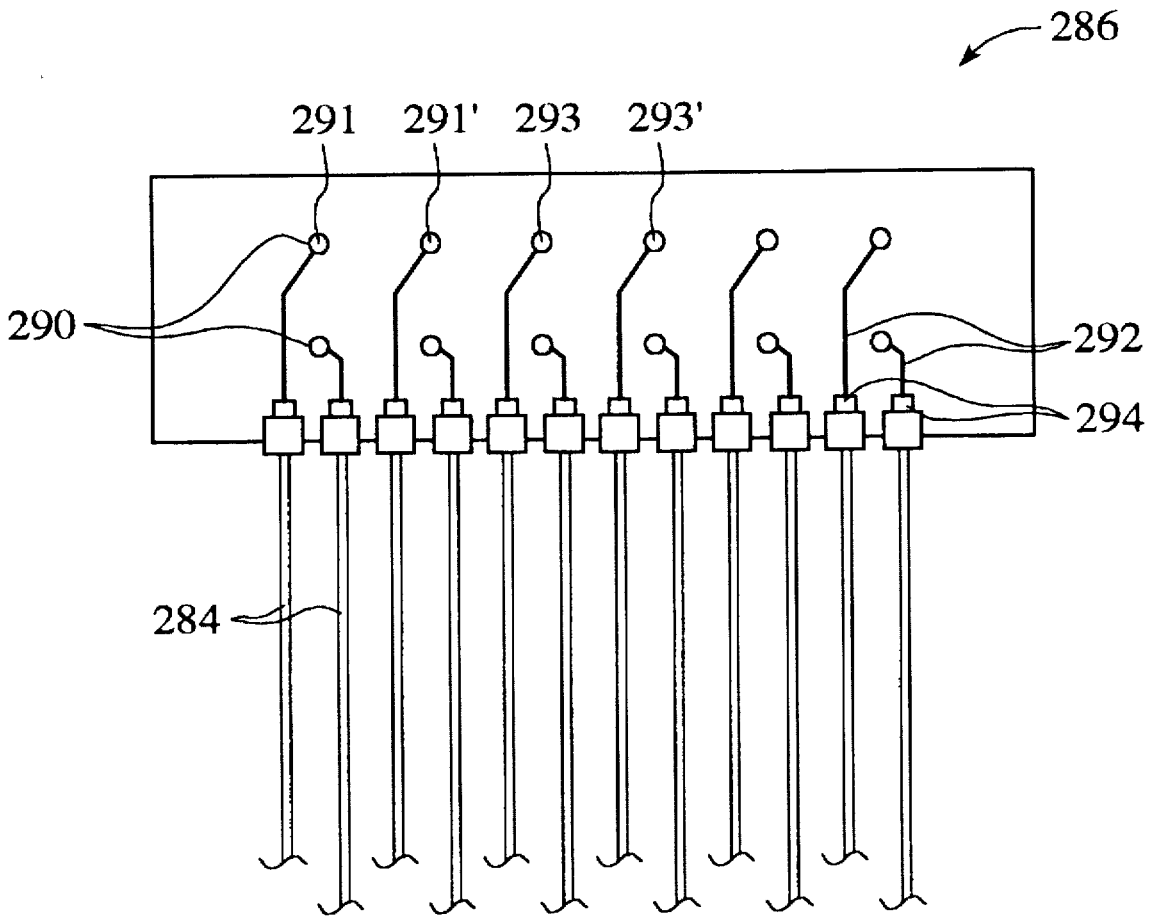
FIG. 13 shows a printed circuit board for the lead support shown in FIG. 12.
Figure 14A:
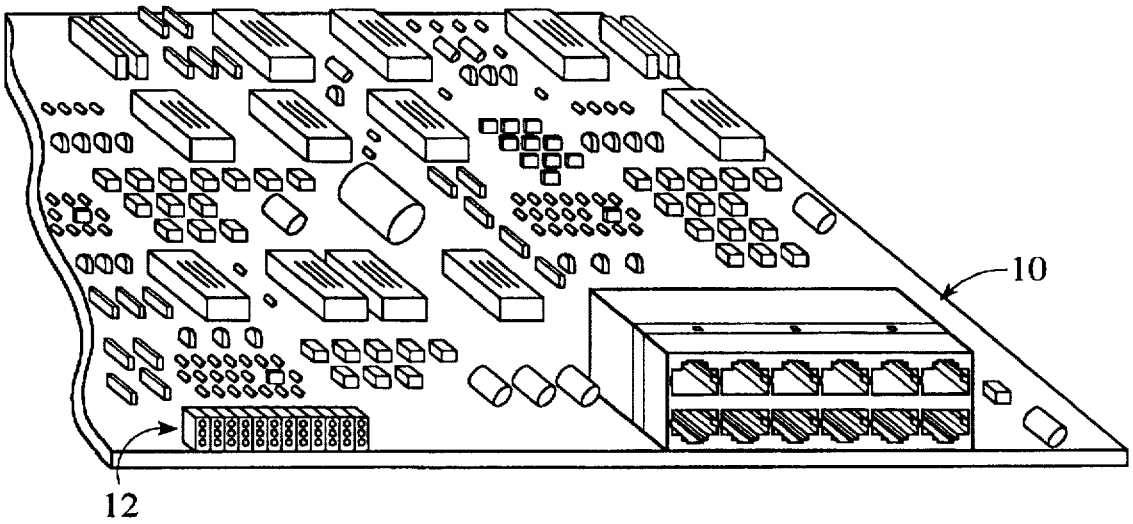
FIGS. 14A and 14B show prior art arrangements of LED placement.
Figure 14B:
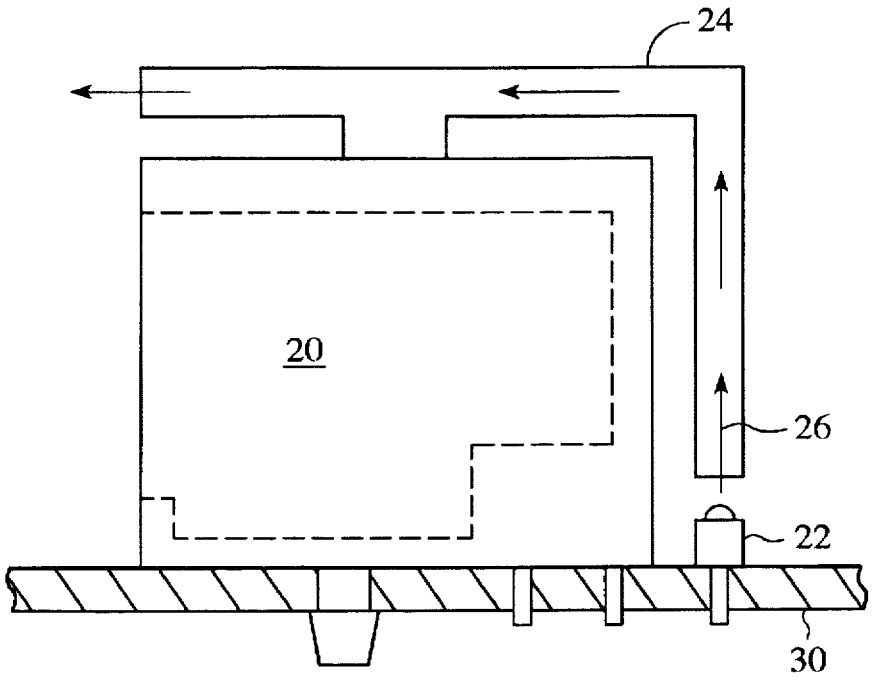

FIG. 13 shows the details of the printed circuit board 286 and the attachment of the mounting leads 284 to the circuit board. The view is taken from the rear of the circuit board 286 looking forward. The circuit board includes a set of conductive vias 290 into which the LED leads 144 are inserted. Traces 292 provide electrical paths from the vias 290 to corresponding contact pads 294 formed along an edge of the circuit board 286. The mounting leads 284 are coupled to the circuit board 286 at the contact pads 294 and extend downwardly. The mounting leads 284 are preferably soldered onto the contact pads 294 to ensure reliable attachment. The method of attachment is not critical and other methods of attachment known in the relevant arts are contemplated.

As explained, the LEDs are oriented so that the leads 144 lie in a horizontal plane in order to attain a low profile. This orientation is reflected in FIG. 13 by the horizontal alignment of the conductive vias 290. For example, the LED leads 144 of a first LED are inserted into a first set of vias 291, 291', the leads of a second LED are inserted into a second set of vias 293, 293', and so on. However, the leads may be oriented vertically or at any angle relative to the horizontal without affecting the operation of the modular jack, the effect only being that a minimum profile is not attained.

Note that the traces 292 are formed such that the first and third mounting leads 284 (from the left) correspond to the vias 291, 291' of the first LED. This pattern of pairs of alternating mounting leads is repeated for the other vias. This pattern of traces 292 is not critical. The pattern can be formed so that the vias of an LED (e.g. 291, 291') are coupled to a pair of adjacent mounting leads.

I claim:

1. A modular jack for receiving a plug comprising:

a generally rectangular housing having a face and a cavity, said cavity divided by a partition into a top chamber and a bottom chamber, said bottom chamber shaped to receive said plug, said face having first and second apertures formed therethrough, said first aperture opening into said top chamber, said second aperture opening into said bottom chamber, said housing further including a shell having an interior region, said face of said housing being a front end of said shell, said housing further including a rear insert received at a rear end of said shell, said partition being a cantilevered member formed on said rear insert, whereby said cavity of said housing is formed upon fitting said rear insert into said shell and said cantilevered member divides said cavity into said top and bottom chambers:

a plurality of contact pins disposed within said bottom chamber; and at least one light emitting diode (LED) element received within said top chamber.

2. The modular jack of claim 1 wherein said at least one LED element includes a bulb portion disposed proximate to said first aperture and further includes LED leads extending from said bulb portion toward said rear end of said shell, said rear insert including a lead frame formed therein, an end of said lead frame protruding beyond a bottom of said rear insert, another end of said lead frame having an internal socket coupled thereto and disposed upon said cantilevered member, whereby said LED lead engages said internal socket when said rear insert is fitted into said rear end of said shell.

3. The modular jack of claim 1 wherein said LED element includes a pair of LED leads enclosed entirely within said top chamber.

4. The modular jack of claim 3 further includes coupling means for connecting to an adjacent modular jack.

5. The modular jack of claim 4 wherein said coupling means is disposed on at least one of left and right exterior sides of said housing, said coupling means being one of a notched region and a raised member.

6. The modular jack of claim 1 wherein each of said contact pins has a contacting portion and a mounting portion, said mounting portion extending downwardly from an upper interior surface of said bottom chamber, proximate a rear wall of said bottom chamber and through a bottom surface of said bottom chamber to the exterior of said housing, said contacting portion having an end proximate said second aperture and extending along said upper interior surface toward said rear wall, the spacing between said contacting portion and said upper interior surface varying along the length of said contacting portion.

7. The modular jack of claim 6 wherein the spacing between said contacting portion and said upper interior surface of said bottom chamber is at a maximum proximate to said second aperture.

8. A modular jack comprising:

a housing member of insulative material having a cavity formed therein, said cavity having a ceiling, a floor and a rear wall, said cavity being shaped for receiving a modular plug, said housing further having an aperture opening into said cavity;

a light emitting diode (LED) assembly disposed atop said cavity and a partition separating said LED assembly from said cavity, said LED assembly having a chamber coextensive with said cavity, said LED assembly further having an LED received in said chamber and a pair of LED leads fully contained within said chamber; and a plurality of contact pins disposed within said cavity;

each of said contact pins having a first end positioned near to said aperture and disposed proximate to said ceiling;

said contact pins extending rearwardly along said ceiling and having a distance from said ceiling that varies with travel toward said rear wall of said cavity;

said contact pins having a downward turn near said rear wall and a downward extent alongside said rear wall, said contact pins protruding through said floor so that second ends of said contact pins project beyond a bottom exterior surface of said housing.

9. The modular jack of claim 8 wherein said LED assembly is unilaterally formed with said housing member.

10. The modular jack of claim 9 wherein said housing includes a first coupling member formed on an exterior surface thereof, and said LED assembly includes a second coupling member which is complementary to said first coupling member, wherein said LED assembly is attached to said housing by mating said first coupling member to said second coupling member.

11. The modular jack of claim 9 wherein said varying distance of said contact pins from said ceiling has a maximum value substantially at the midpoints of the portions of said contact pins extending along said ceiling.

12. A ganged modular jack assembly comprising:

a left-end member; and a right-end member;

each member further comprising:

a housing including a body of insulative material and having an interior cavity divided into a light emitting diode (LED) chamber and a plug receiving chamber, said housing further having exterior left, right and bottom surfaces, said LED chamber extending from a front of said housing toward a rear of said housing and being disposed atop said plug receiving chamber;

contact pins disposed within said plug receiving chamber;

at least one LED disposed within said LED chamber, said at least one LED having a pair of LED leads substantially contained within said LED chamber and extending toward said rear of said housing; and first and second connector leads disposed within said body of insulative material and toward said rear of said housing, an end of each connector lead being electrically coupled to one of said LED leads, another end of each connector lead extending through said exterior bottom surface of said housing;

said left-end member having a coupling member formed on said exterior right surface of said housing;

said right-end member having a coupling member formed on said exterior left surface of said housing.

13. The ganged modular jack assembly of claim 12 further including a middle member having a housing and a coupling member formed on each of exterior left and right surfaces of said housing, whereby a gang of modular jacks is assembled by connecting together one or more of said middle members and connecting said left-side member on the left side thereof and said right-side member on the right side thereof.

14. The ganged modular jack assembly of claim 12 wherein said LED chamber is separated from said plug receiving chamber by a partition, said partition defining a ceiling within said plug receiving chamber, each of said contact pins having an end located proximal to said front of said housing, said contact pins extending from said front toward a rear of said plug receiving chamber alongside said ceiling and with a varying measure of separation from said ceiling.

15. The ganged modular jack assembly of claim 14 wherein portions of said contact pins extending alongside said ceiling have a maximum separation from said ceiling at midpoints of said portions of said contact pins.

16. A stacked modular jack adapted for mounting on a printed circuit board, said stacked modular jack comprising:

a housing member having two vertically-aligned plug-receiving chambers, an upper plug-receiving chamber and a lower plug-receiving chamber, formed therewithin;

a light emitting diode (LED) assembly having two vertically aligned LED-receiving chambers, said LED assembly being disposed atop said housing member;

at least one LED received within each of said LED-receiving chambers, each LED having a pair of LED leads extending toward a rear of said LED-receiving chamber; and contact pins received within said plug-receiving chambers.

17. The stacked modular jack of claim 16 further including coupling means disposed on right and left exterior sides of said housing member, and wherein said LED assembly is unitarily formed with said housing member.

18. The stacked modular jack of claim 16 wherein said housing member includes a first coupling member formed on an exterior top surface thereof, and said LED assembly includes a second coupling member which is complementary to said first coupling member, whereby said LED assembly is attached to said housing by mating said first coupling member to said second coupling member.

19. The stacked modular jack of claim 16 wherein said contact pins each have a downwardly-extending portion which extends beyond a bottom exterior of said housing member for mounting on said printed circuit board and wherein said LED assembly further includes:

a printed circuit board having at least two conductive vias formed therethrough, each via having a conductive trace which terminates at a contact pad proximate to an edge of said board, said pair of LED leads being connected to said vias;

at least two mounting leads each connected to one of said contact pads and extending in a direction generally parallel to said downwardly-extending portions of said contact pins for mounting on said printed circuit board; and a lateral support member by which said mounting leads are held in fixed position, thereby preventing lateral displacement of said mounting leads.

20. The stacked modular jack of claim 16 wherein end portions of said contact pins disposed within said upper plug receiving chamber are positioned toward a front of said upper plug receiving chamber, said upper contact pins extending toward a rear of said upper plug-receiving chamber proximate to a ceiling of said upper plug-receiving chamber and with a distance from said ceiling that varies with travel from said front to said rear of said upper plug receiving chamber.

21. The stacked modular jack of claim 20 wherein portions of said contact pins extending proximate to said ceiling each have a maximum distance from said ceiling near a midpoint of said portion.

* * * * *